US006138664A

United States Patent [19]

Hanada et al.

[11] Patent Number: 6,138,664

[45] Date of Patent: Oct. 31, 2000

[54] WARMING JACKET

[75] Inventors: Toru Hanada, Hyogo; Kiyonobu Yoshida; Tomoaki Kitano, both of Nara; Koji Nakai; Shinichi Ito, both of Hyogo; Kenjiro Tomita, Osaka; Tadashi Ando, Nara; Hidetaka Yabuuchi; Takaaki Kusaka, both of Hyogo, all of Japan

[73] Assignee: Matsushita Electric Industrial Co., Ltd., Osaka, Japan

[21] Appl. No.: 09/280,523

[22] Filed: Apr. 5, 1999

[30] Foreign Application Priority Data

| | | | |
|---|---|---|---|
| Apr. 6, 1998 | [JP] | Japan | 10-093100 |
| Jul. 13, 1998 | [JP] | Japan | 10-197079 |
| Dec. 25, 1998 | [JP] | Japan | 10-369165 |

[51] Int. Cl.[7] ..... A41D 13/005

[52] U.S. Cl. ..... 126/208; 431/6

[58] Field of Search ..... 126/204, 206, 126/208; 219/211; 431/6, 7, 268

[56] References Cited

U.S. PATENT DOCUMENTS

| | | | |
|---|---|---|---|
| 3,110,301 | 11/1963 | Bricker | 126/208 |
| 4,061,897 | 12/1977 | Thykeson | 219/211 |
| 4,458,667 | 7/1984 | Hsieh | 126/208 |
| 4,685,442 | 8/1987 | Cieslak | 126/206 |
| 5,072,455 | 12/1991 | St. Ours . | |
| 5,217,408 | 6/1993 | Kaine . | |
| 5,282,740 | 2/1994 | Okayasu | 126/204 |
| 5,564,124 | 10/1996 | Elsherif et al. . | |

FOREIGN PATENT DOCUMENTS

| | | |
|---|---|---|
| 0 014 300 | 8/1980 | European Pat. Off. . |
| 803206 | 10/1997 | European Pat. Off. . |
| 2054336 | 4/1971 | France . |
| 48-005094 | 12/1972 | Japan . |
| 50-8039 | 3/1975 | Japan . |
| H10-274402 | 10/1998 | Japan . |

*Primary Examiner*—Ira S. Lazarus
*Assistant Examiner*—Sara Clarke
*Attorney, Agent, or Firm*—Wenderoth, Lind & Ponack, L.L.P.

[57] ABSTRACT

A catalytic combustion heating device 3 for generating heat by oxidation reaction of fuel gas stored in a fuel tank 24 and air in a combustion unit 29 is installed in a mount 4 provided in a jacket 1. The mount 4 is fastened to the waist of the body wearing the jacket 1 by a holding band 9, and the load applied on the shoulders through the jacket is lessened and comfort is improved. Thus, a warming jacket capable of warming the body comfortably is obtained.

40 Claims, 9 Drawing Sheets

WARMING JACKET

FIELD OF THE INVENTION

The present invention relates to a warming jacket for warming the human body by providing a jacket with a catalytic combustion heating device.

BACKGROUND OF THE INVENTION

Hitherto, as a warming device for warming part of the body, a body warmer for heating the body by using the heat obtained from chemical reaction of iron oxide powder is common. It is designed to be adhered easily to any position by using an adhesive, and it is easy and inexpensive. Thus, it is widely used.

As disclosed in JP Laid-open Utility Model No. 49-108290, a warming cloth incorporating an electric heater inside is worn at an arbitrary position of the body, and it is heated by a battery or other power source. The power source is not limited to battery, and a commercial power source may also be used.

As an example of warming part of the body by using the heat obtained by catalytic combustion of liquefied petroleum gas, an application in a foot warmer as disclosed in JP Laid-open Utility Model No. 50-8039 is known.

Moreover, EP No. 0803206 discloses a means of warming the body by attaching a catalytic combustion heating device making use of liquefied petroleum gas to the clothes.

In such conventional warming devices, in the case of making use of a chemical reaction, since there is no temperature control means, it is hard to warm the body comfortably at an arbitrary temperature corresponding to the ambient temperature. Furthermore, the temperature declines in a short time, so that it must be designed to be disposable.

On the other hand, in the case of heating an electric heater by battery or other power source, when the apparatus is used in a cold district where the ambient temperature is low, it is hard to warm the body to a comfortable temperature. Thus, the power source must be extremely large in size for obtaining a necessary and sufficient heat quantity. Consequently, it is heavy and not easy to use, and it is far from practical to be worn on the body.

Or, in the case of using commercial power source as the power source for heating the electric heater, a power cord must be provided and connected to a commercial power outlet. Therefore, it cannot be used outdoors or in other areas where a power source is not available.

To solve so many practical problems, it has been proposed to warm the body by furnishing a jacket with a catalytic combustion heating device. According to this method, heating for a long time is possible only by refilling fuel gas, and a sufficient heat quantity is obtained if used in a cold district where a power source is not available, so that the body can be warmed to a comfortable temperature.

However, such catalytic combustion heating device is complicated in structure and heavy in weight. When the jacket is worn, its weight is applied on the shoulders through the jacket, and so it does no feel good to wear, and when worn for a long time or when moving the arms, loading is heavy and it is easy to fatigue. This problem becomes more obvious when the jacket is modified from the heavy winter clothes to a light and thin jacket.

It is a merit of the catalytic combustion heating device that the temperature can be adjusted and kept constant by controlling the feed rate of fuel gas. At this time, by feeding the fuel gas while the catalyst is within the catalytic combustion temperature, catalytic combustion can be continued. In other words, it is hard to control the temperature below the catalytic combustion temperature, and it is hard to warm the body at a comfortable temperature by controlling the catalytic combustion heating device at a low temperature depending on the ambient temperature.

SUMMARY OF THE INVENTION

The invention hence presents a warming jacket capable of warming the body comfortably at an arbitrary place, and it is a first object thereof to improve the feeling of wearing the jacket by reducing the weight applied to the shoulders through the jacket when the jacket is worn. It is a second object to realize a warming jacket in a simple design. It is a third object to warm the body comfortably depending on the ambient temperature. Other objects are clarified in the following detailed description.

To achieve these objects, the invention provides a catalytic combustion heating device for generating heat by oxidation reaction of fuel gas stored in a fuel tank and air in a catalytic combustion heating unit. This catalytic combustion heating device is attached to a mount provided in a jacket, and this mount is fastened to the body wearing the jacket by means of a holding band. As a result, the load of the catalytic combustion heating device applied on the shoulders through the jacket when the jacket is worn is dispersed and lessened by the holding band. Consequently, the comfort of wearing the jacket is improved, and the burden and fatigue can be alleviated.

The invention also provides a catalytic combustion heating device for generating heat by oxidation reaction of fuel gas stored in a fuel tank and air in a catalytic combustion heating unit. A moving passage of warm air heated by the catalytic combustion heating device is formed between a coat worn over the jacket and the jacket. As a result, the jacket for wearing the catalytic combustion heating device can be simplified as an inner shirt worn under the coat. By wearing a desired coat thereover, the body can be warmed comfortably, and it is not necessary to detach and attach the catalytic combustion heating device when exchanging a variety of coats.

DETAILED DESCRIPTION OF THE INVENTION

Figure 1:
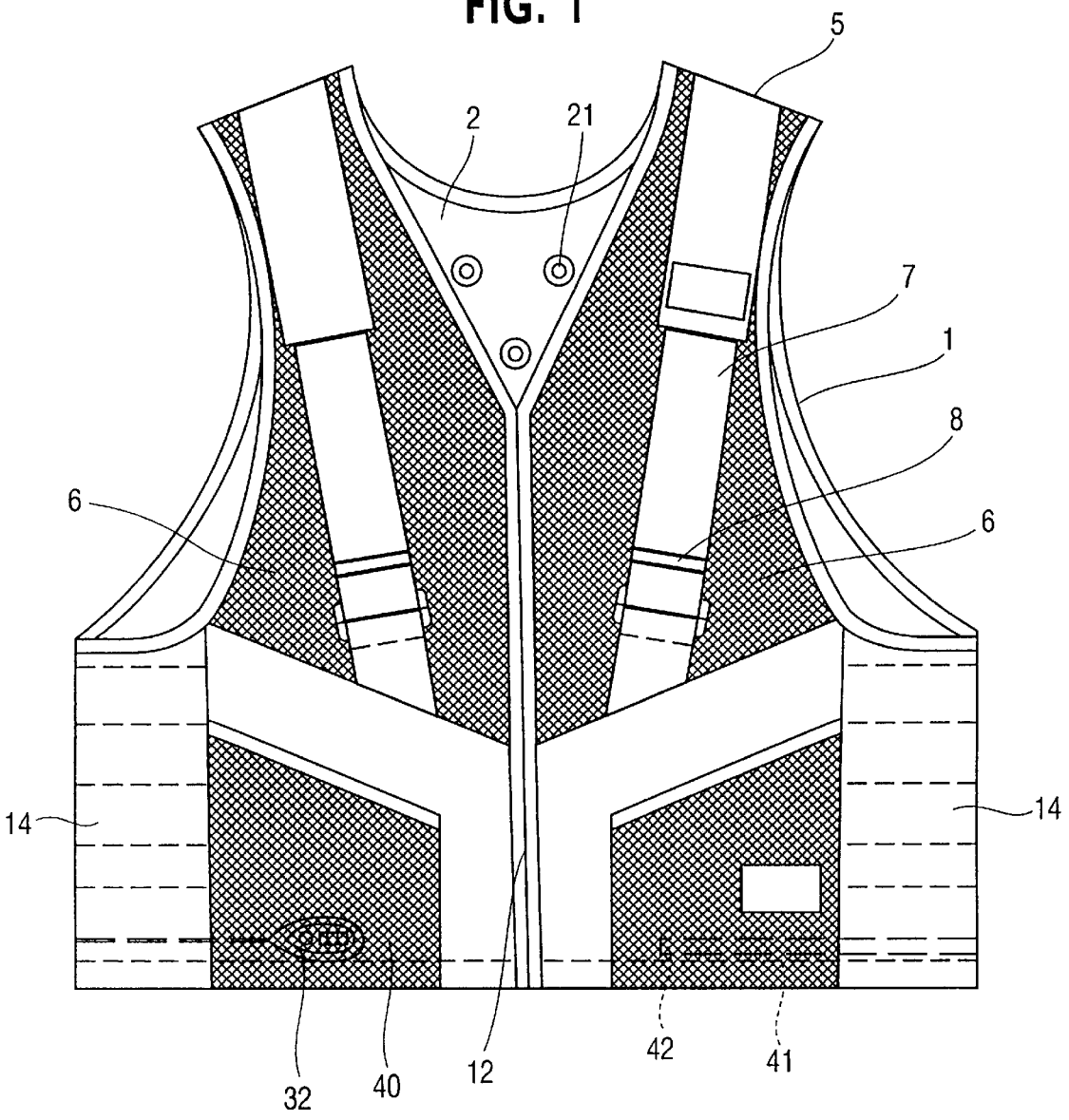
FIG. 1 is a front view of a warming jacket in a first embodiment of the invention.
Figure 2:
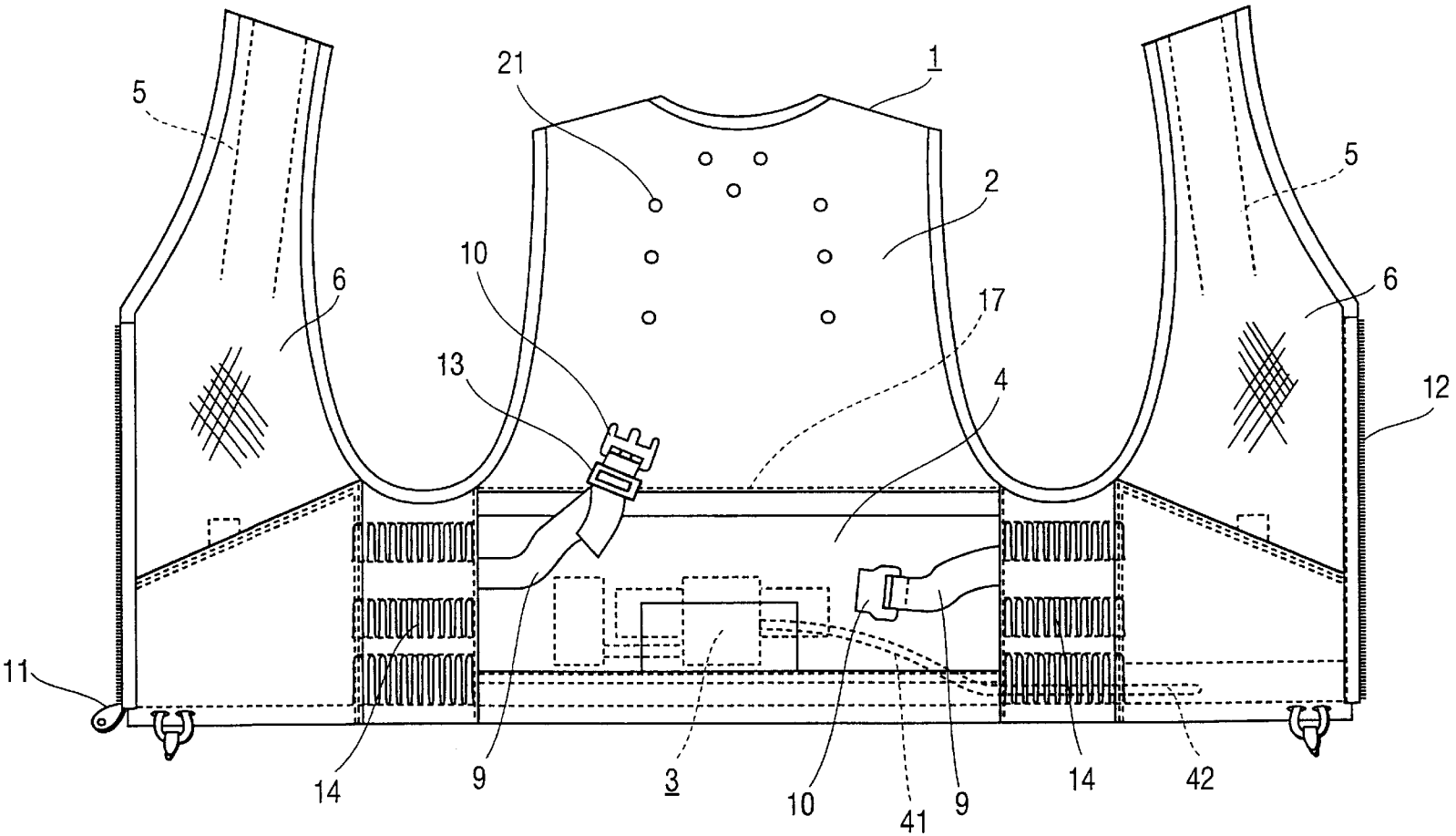
FIG. 2 is an inside view with the front part of the warming jacket open.
Figure 3:
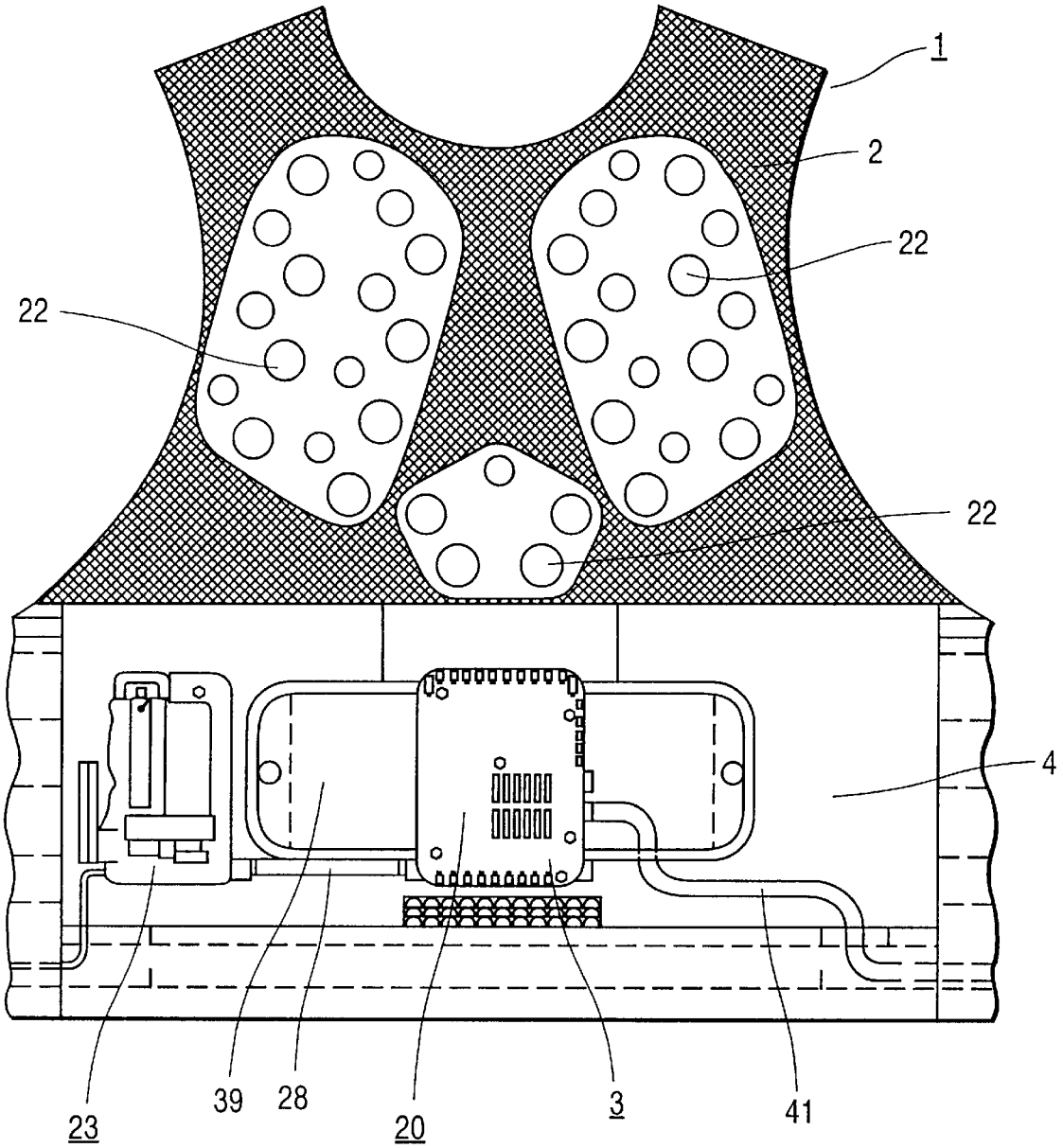
FIG. 3 is an internal structure of the back part of the warming jacket.
Figure 4:
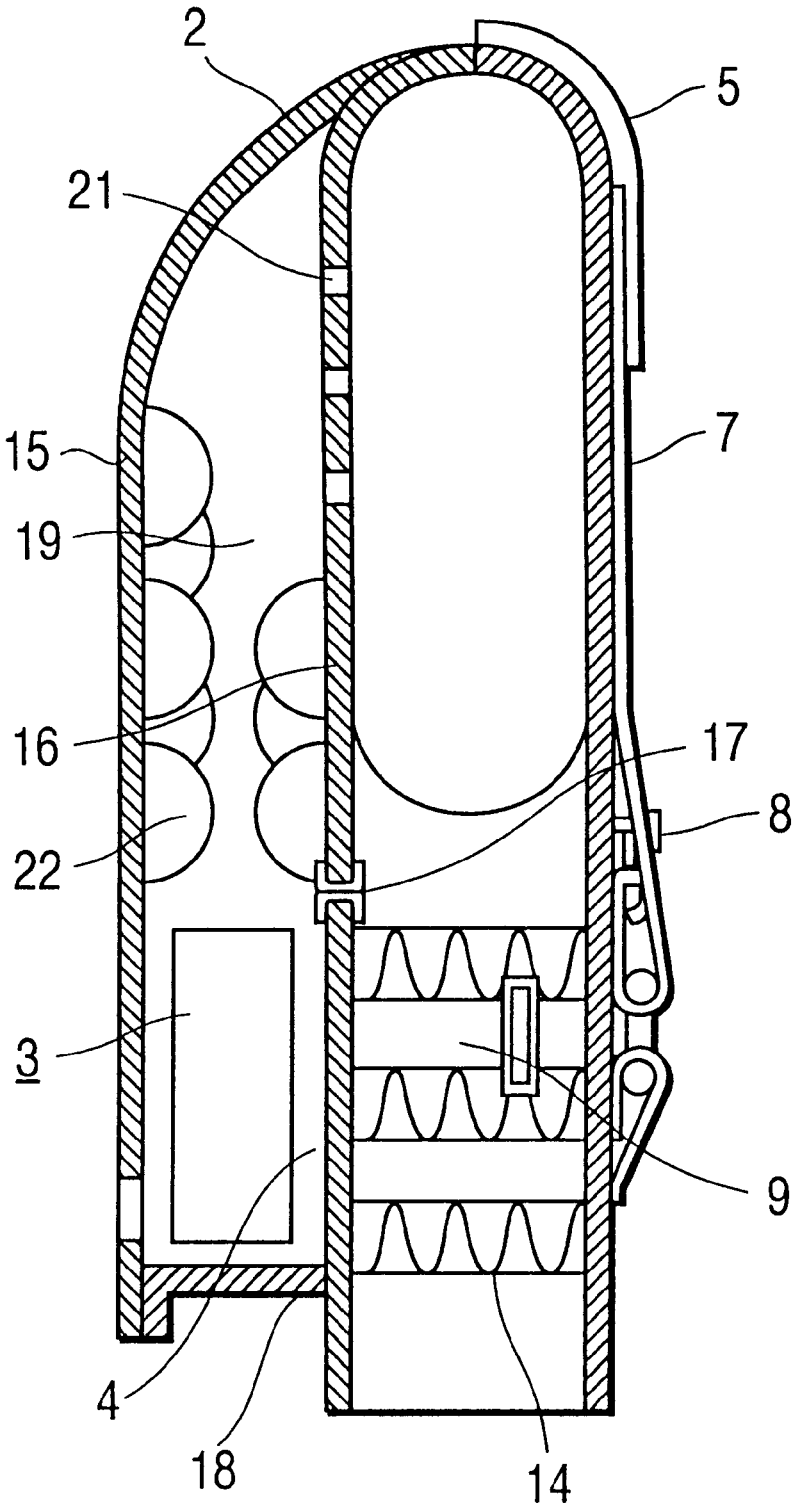
FIG. 4 is a side sectional view of the warming jacket.

Referring now to the drawings, embodiments of the invention are described below.

(Embodiment 1)

As shown in FIG. 1 to FIG. 4, a jacket 1 is manufactured in a simple form such as a vest, and is designed to be worn on the upper half of the body. A mount 4 for mounting a catalytic combustion heating device 3 is provided in the lower part of a back part 2. A linking string 7 is stretched between a pair of right and left shoulder belts 5 provided in the upper part of the back part 2 and a front part 6, and its length can be adjusted by an adjuster 8. Reference numeral 9 denotes a holding band for fastening the mount 4 to the body, and it can be detachably linked by means of a buckle 10, and provided inside of a coupling member 12 formed of a fastener 11 or the like for coupling the two side sections of the front part 6 of the jacket 1. Therefore, the mount 4 can be fastened to the waist of the body wearing the jacket 1 even when the front part 6 is opened by the coupling member 12. The holding band 9 is designed to be adjustable in length when fastened by means of an adjuster 13. The front part 6 of the jacket 1 is composed of mesh or other air permeable fibers, and this front part 6 and the back part 2 are stretchably linked by way of an elastic part 14.

The back part 2 of the jacket 1 is composed of a surface cloth 15 provided on the outside and a lining 16 provided on the inside. The mount 4 can be opened or closed by the opening 17 provided in the lining 16 by means of a fastener or the like, so that the catalytic combustion heating device 3 can be put in and taken out of the mount 4 by way of this opening 17. The catalytic combustion heating device 3 is fixed so as not to move in the state installed in the mount 4, and the mount 4 is formed by providing a gusset 18 larger than the thickness of the catalytic combustion heating device 3. Above the mount 4 there is a moving passage 19 of warm air heated by a catalytic combustion heating unit 20 of the catalytic combustion heating device 3, and which communicates with the mount 4. The warm air is diffused to the back part 2, and warm air is released to the body side from the back part 2 of the jacket 1 through air vents 21 provided in the lining 16. Multiple hemispherical spacers 22 made of elastic and repulsive material such as sponge project within moving passage 19. The spacers 22 maybe provided on either surface cloth 15 or lining 16, or on both.

Figure 5:
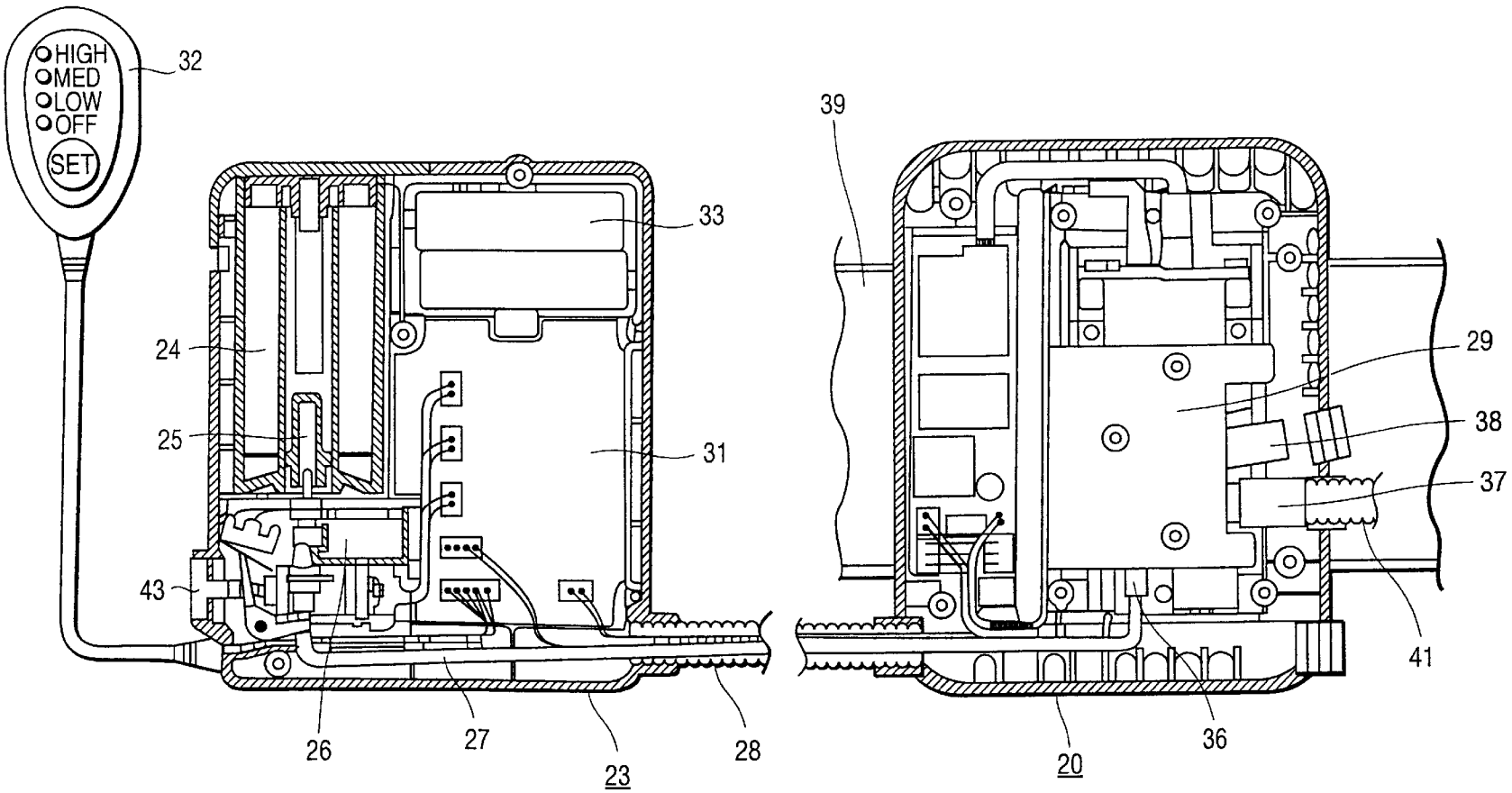
FIG. 5 is an essential sectional view of a catalytic combustion heating device of the warming jacket.
Figure 6:
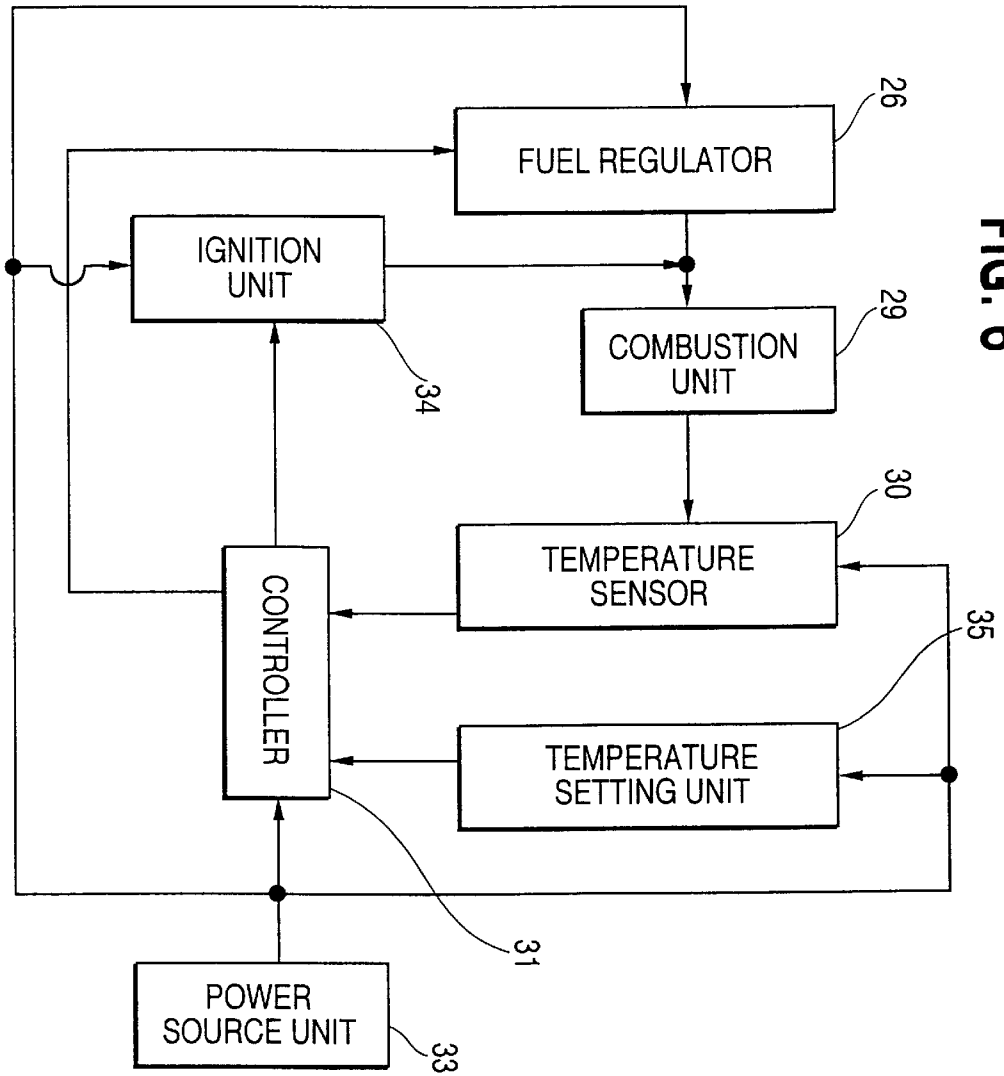
FIG. 6 is a block diagram of essential parts of the catalytic combustion heating device of the warming jacket.

The catalytic combustion heating device 3 is described below. As shown in FIG. 5 and FIG. 6, a fuel tank unit 23 includes a fuel tank 24 for storing fuel gas (such as liquefied petroleum gas like butane, propane or their mixture), and a cartridge filled with fuel is detachably provided in the fuel tank unit 23. The fuel gas in the fuel tank 24 is vaporized in a vaporization device 25, and is supplied into the catalytic combustion heating unit 20 via a flexible fuel passage 27 and through a fuel regulator 26 which includes a solenoid valve. The catalytic combustion heating unit 20, linked to the fuel tank unit 23 through a flexible communicating tube 28, generates heat by catalytic combustion by oxidation reaction of fuel gas and air by a catalyst (not shown) provided in a combustion unit 29.

The fuel tank unit 23 has a controller 31 for controlling the flow of fuel so that the catalytic combustion heating unit 20 may be heated to a preset temperature. By detecting the temperature of the combustion unit 29 by a temperature sensor 30 such as thermistor, and by turning on or off the fuel regulator 26, supply of fuel gas into the catalytic combustion heating unit 20 is controlled. The controller 31 is composed of control circuits made of multiple electronic components disposed on a printed circuit board. An operation unit 32 connected to the controller 31 is drawn out of the fuel tank unit 23 by a specified length, and is responsible for setting the temperature to heat the catalytic combustion heating unit 20 to a specified temperature, and for the on/off setting for ignition of fuel gas and stopping of combustion relating to this temperature setting. A power source unit 33 a battery or the like, and supplies power to the controller 31, ignition unit 34, fuel regulator 26, temperature sensor 30, and temperature setting unit 35 to operate them.

The catalytic combustion heating unit 20 comprises a nozzle 36 for injecting fuel gas to the combustion unit 29, an intake 37 for taking in air for mixing with the fuel gas, the ignition unit 34 for striking a spark by high voltage discharge to ignite the mixed gas of fuel gas and air, and an exhaust unit 38 for discharging the exhaust gas fired by the combustion unit 29. The catalytic combustion heating unit also includes a catalyst for inducting an oxidation reaction of the fuel gas and air. A heating sheet 39 is composed of a textile material formed by knitting highly heat conductive metallic fibers, and is attached to the catalytic combustion heating unit 20, so as to be held in the mount 4 of the jacket 1. The catalytic combustion heating device 3 is composed of the fuel tank unit 23 and catalytic combustion heating unit 20.

Mounting of the catalytic combustion heating device 3 on the jacket 1 is described below. The opening 17 of the lining 16 provided in the back part 2 of the jacket 1 is opened from inside, the catalytic combustion heating device 3 is put into the mount 4 and fixed at specified position. The heating sheet 39 is also positioned in the mount 4, and the opening 17 is closed. The operation unit 32 extending out from the fuel tank unit 23 is designed to be held within a pocket 40 provided in the front part 6 of the jacket 1. An air pipe 41 connected to the intake 37 of the catalytic combustion heating unit 20 is extended to the front part 6 of the jacket 1 remote from the mount 4, and fresh air is taken in from an air inlet 42 provided at its leading end, and supplied into the catalytic combustion heating unit 20. When removing the catalytic combustion heating device 3 from the jacket 1, it can be taken out by opening the opening 17 of the lining 16 from the inside.

Wearing of the jacket 1 on the body is described below. First, a pair of right and left shoulder belts 5 are applied on both shoulders, and the length of the linking string 7 is adjusted to a proper length by the adjuster 8. One end is coupled with the detachable buckle 10 provided at one end of the holding band 9 and fitted near the mount 4. The length is adjusted and fixed so that the mount 4 may coincide with the waist of the body. The holding band 9 is provided inside of the front part 6 of the jacket 1, the mount 4 is fastened to the body when the coupling member 12 (composed of fastener 11 or the like for coupling the front part 6) is open, and then the opening side 12 provided in the front part 6 is closed. At this time, since the elastic part 14 is provided, the elastic part 14 expands or contracts depending on the physique of the body, so that the jacket 1 is worn on the body without allowing a gap between the jacket and the body regardless of the physique.

The operation of the catalytic combustion heating device 3 is described below. First, when warming the body, a start switch 43 provided in the fuel tank unit 23 is turned on to open the fuel regulator 26, and the fuel gas is supplied into the combustion unit 29 through the fuel passage 27. The fuel gas supplied in the combustion unit 29 is gas, and fuel gas injected from the nozzle 36 sucks in air from the intake 37 through the air pipe 41 to be a mixed gas.

When the start switch 43 is turned on, the power source unit 33 is started, and the ignition unit 34 functions to strike a spark. When the mixed gas in the combustion unit 29 is ignited to create a flame, the operation of the ignition unit 34 is no longer necessary. The generated flame heats the catalyst supporting the platinum, and when reaching the temperature for oxidation reaction by catalyst, the operation is transferred to catalytic combustion. The transfer temperature to general catalytic combustion is about 200° C. When transferred to catalytic combustion, the gas flowing into the ignition unit 34 is exhaust gas, and the flame is extinguished.

Herein, by selecting an arbitrary temperature by using the operation unit 32 when setting the preset temperature, the temperature of the combustion unit 29 is detected by the temperature sensor 30, and the catalytic combustion heating unit 20 is controlled to the preset temperature. The controller 31 is designed to turn on the fuel regulator 26 and also turn on the ignition unit 34 for a specific time if the temperature of the combustion unit 29 is lower than the temperature preset by the temperature setting unit 35.

Figure 7:
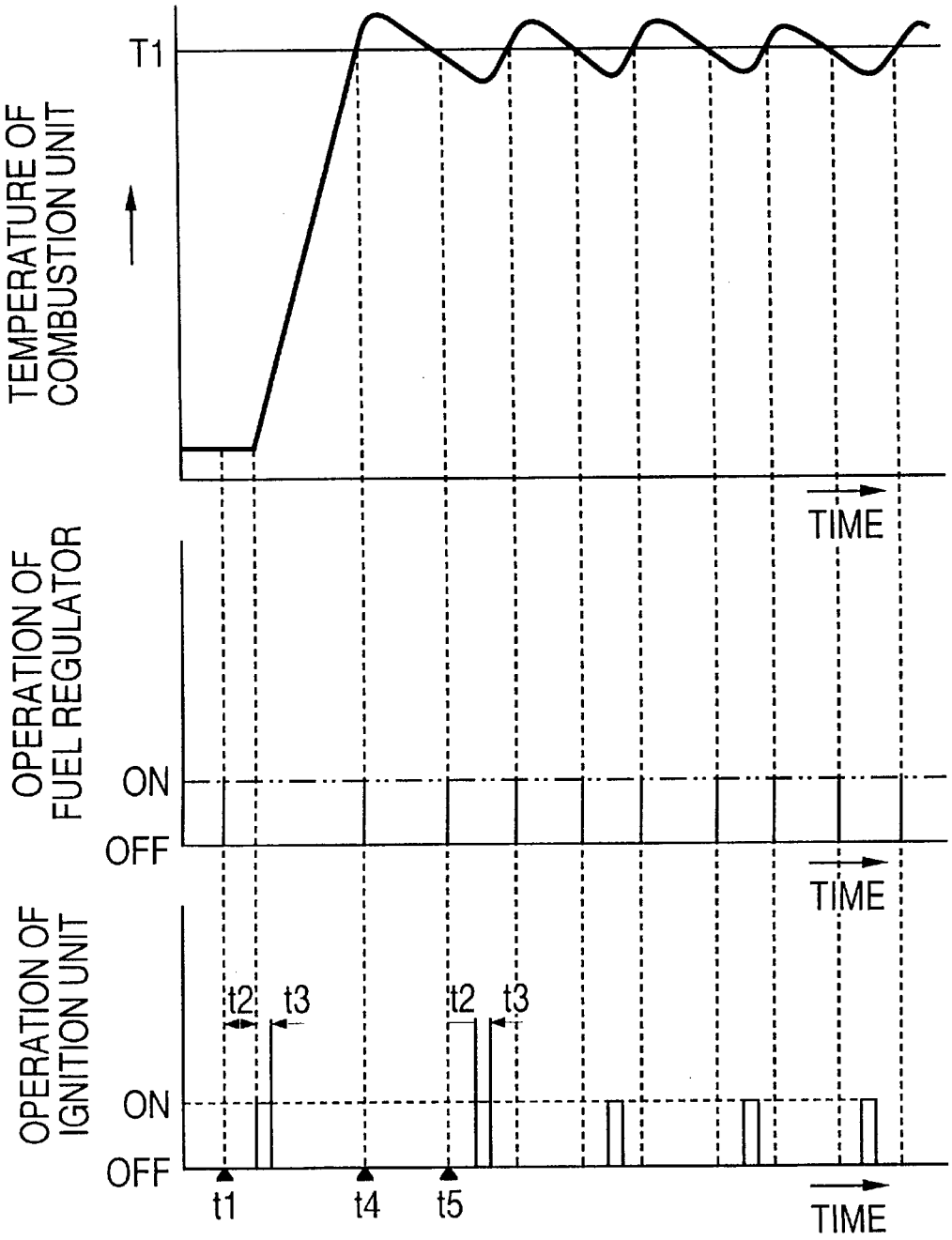
FIG. 7 is an operation timing chart of the catalytic combustion heating device of the warming jacket.

The operation of the catalytic combustion heating device 3 is further described while referring to FIG. 7. In the case of control of temperature of the combustion unit 29 at T1, when the power source is turned on at time t1, the fuel regulator 26 (which includes a solenoid valve and others) is turned on, and the fuel gas is supplied into the combustion unit 29. The controller 31 turns on the fuel regulator 26, and after passing to time t2, the ignition unit 34 is turned on, and spark discharge is generated to ignite the fuel gas. The operation of the ignition unit 34 continues for a specific time t3, and stops after ignition on the fuel gas is assured.

When a flame is generated by ignition of the fuel gas, the generated flame heats the catalyst and combustion unit 29, and when elevated to a specified temperature, the operation is transferred to catalytic combustion. When the catalytic combustion starts, exhaust gas is supplied into the flame area, and the flame extinguishes spontaneously. When the temperature of the combustion unit 29 by catalytic combustion reaches the preset temperature T1, the controller 31 turns off the fuel regulator 26 (at time t4), and the supply of fuel gas into the combustion unit 29 stops.

The temperature of the combustion unit 29 rises slightly due to overshoot when the fuel regulator 26 is turned off, and then begins to decline. When the temperature of the combustion unit 29 descends to the preset temperature T1 (at time t5), the controller 31 turns on the fuel regulator 26 again. In time t2 after turning on the fuel regulator 26, the ignition unit 34 is turned on, and this operation of the ignition unit 34 continues for specific time t3, and the ignition operation is repeated.

At this time, the set temperature T1 of the combustion unit 29 is high, and the temperature is ready for catalytic combustion. When the temperature of the combustion unit 29 rises above the set temperature T1, the fuel regulator 26 is turned on to supply fuel gas into the combustion unit 29, the combustion continues, and operation of the ignition unit 34 is not necessary. However, the invention is designed to operate the ignition unit 34 even at this time. Therefore, when the catalytic combustion ready temperature of the combustion unit 29 fluctuates, secure operation is guaranteed by a simple constitution.

Further, if the temperature T1 is set lower than the catalytic combustion ready temperature, the temperature is elevated by igniting again, and this operation is repeated to keep the temperature of the combustion unit 29 constant. In the invention, as a preferred set temperature for warming the body at a comfortable temperature, the jacket is designed to set the temperature in three stages in a range of about 80 to 130° C. In addition, it is designed to turn on the ignition unit 34 in a specific time t2 after the fuel regulator 26 is turned on, and spark discharge is generated after the fuel gas is supplied into the ignition unit 34 so as to ignite securely.

Thus, the warm air heated by the catalytic combustion heating unit 20 gets into the moving passage 19 from the mount 4 to diffuse in the back part 2. The warm air diffused into the moving passage 19 is released from the air vents 21 provided in the lining 16 to warm the body. Moreover, since the mount 4 mounting the catalytic combustion heating device 3 is fastened to the waist of the body by the holding band 9, and the load applied on the shoulders of the body through the jacket 1 is reduced and dispersed to the waist, the burden and fatigue applied on the shoulders are alleviated. Thus, a comfortable wearing feel is obtained.

Furthermore, the holding band 9 is provided inside of the front part 6 of the jacket 1, and the mount 4 can be fastened to the body while the coupling member 12 is open. Therefore, if the jacket 1 is worn loosely, the mount 4 can be attracted to the body to warm securely.

The holding band 9 is not only adjustable in length when fastened by means of the adjuster 13, but is also free to expand or contract. In this case, since the holding band 9 expands or contracts depending on the motion of the body, the restrictive feeling to the body is alleviated, and the freedom of motion is guaranteed.

(Embodiment 2)

Figure 8:
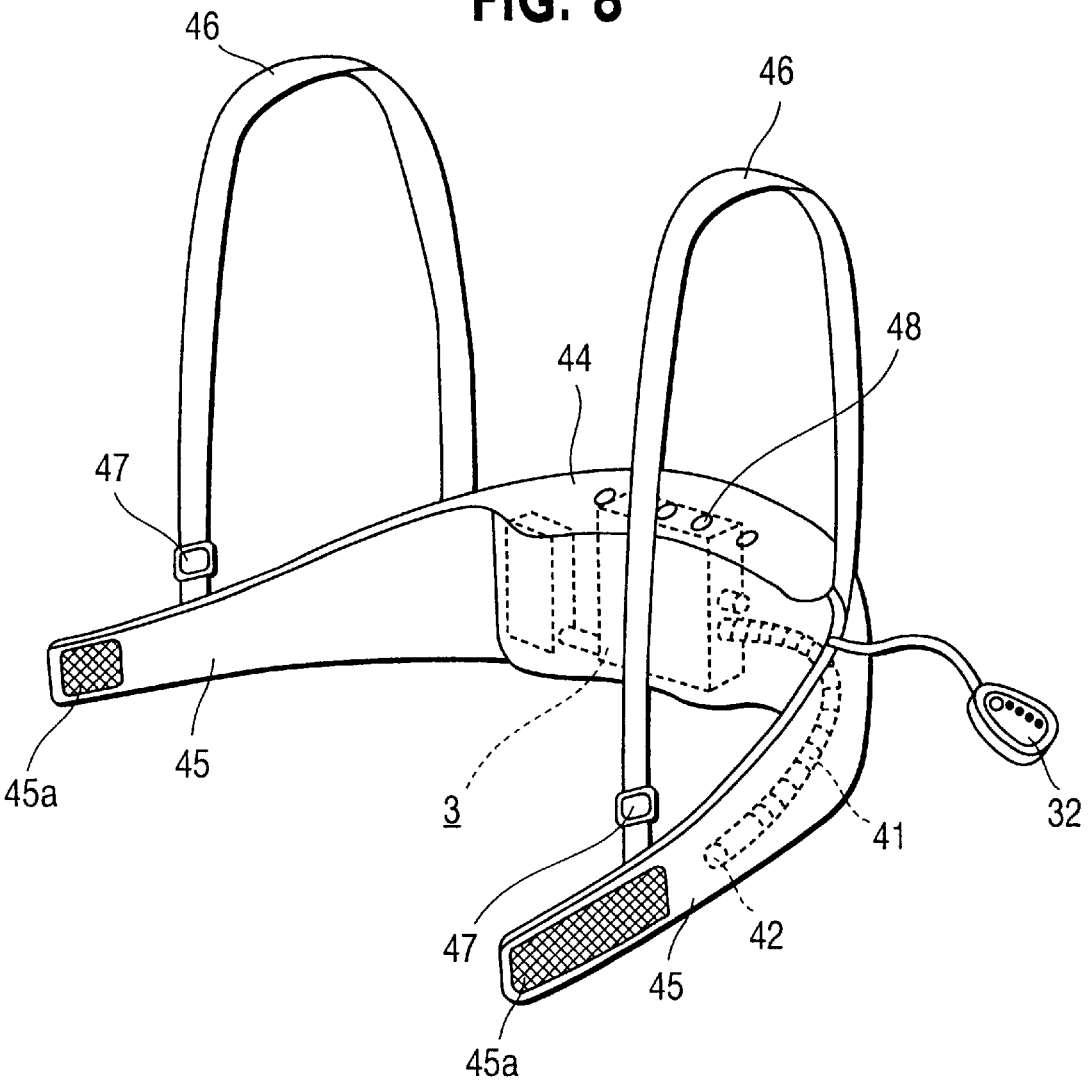
FIG. 8 is a perspective view of a warming jacket in a second embodiment of the invention.

As shown in FIG. 8, a holding band 45 is attached to a mount 44 for mounting a catalytic combustion heating device 3. The holding band 45 is held at the waist of the body by detachably coupling with a surface fastener 45*a* provided on an end portion, and a pair of shoulder straps 46 are attached to the mount 44. The shoulder straps 46 are applied on the shoulders of the body so as to hold the mount 44 by the shoulders and the waist. The length of the shoulder straps 46 can be adjusted by an adjuster 47. The shoulder straps 46 may be detachably held in the mount 44.

According to this embodiment, the load of the mount 44 for mounting the catalytic combustion heating device 3 is dispersed into the shoulders and the waist, and the burden and load applied on the shoulders are alleviated to obtain a comfortable wearing feel. Moreover, by wearing a coat thereabove to cover the mount 44, the warm air released from a releasing area 48 provided in the upper part of the mount 44 will fill up the inside of the coat, so that the upper half of the body can be warmed comfortably. In addition, in order to move the warm air smoothly by forming a gap between the body and the coat, the spacers 22 described in embodiment 1 may be also formed in the shoulder straps 46.

(Embodiment 3)

Figure 9:
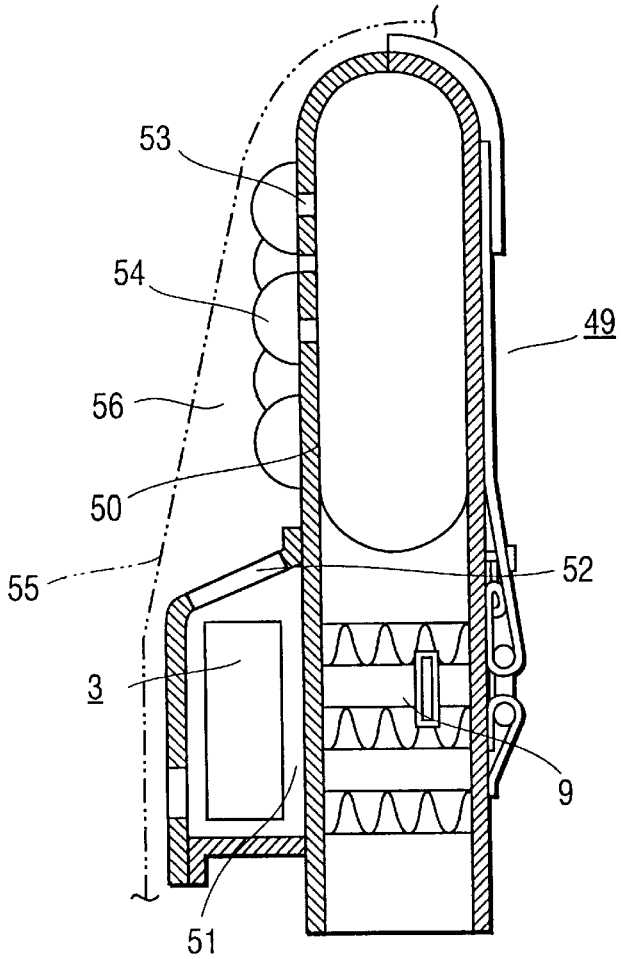
FIG. 9 is an essential sectional view of a warming jacket in a third embodiment of the invention.

As shown in FIG. 9, a mount 51 is provided in a back part 50 of a jacket 49, and a catalytic combustion heating device 3 is detachably mounted therein. An opening 52 for releasing warm air in the upper part of the mount 51 is also provided. Air vents 53 are provided above the opening 52 of the back part 50, and multiple spacers 54 projecting to the outside of the back part 50 are provided. A moving passage 56 of warm air released from the opening 52 is formed between a coat 55 worn thereover and the jacket 49.

According to this embodiment, it is not necessary to form a moving passage of warm air in the jacket 49, and the constitution of the jacket 49 is simplified. By wearing a desired coat thereover, the inside of the coat is filled with warm air and the body is warmed, so that a warming jacket may be realized at low cost.

Figure 10:
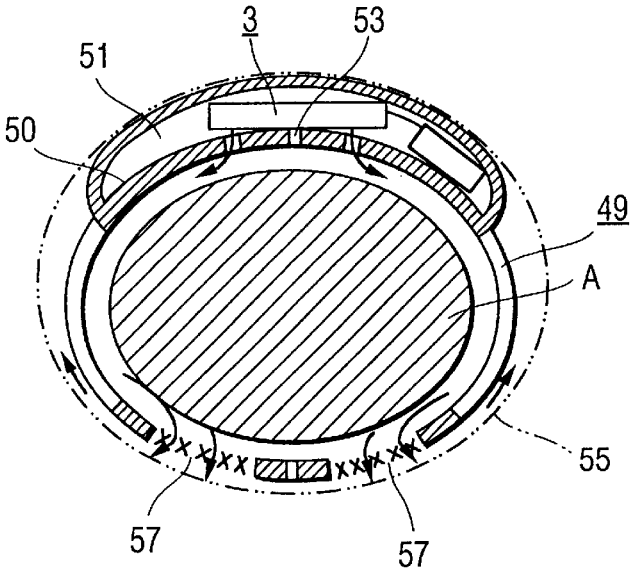
FIG. 10 is an essential sectional view showing the state of use of the warming jacket.

The warm air released from the air, vents 53 of the back part 50 of the jacket 49 circulates, as shown by arrow in FIG. 10, between the jacket 49 and the body A to get into the front side within the jacket 49. The air is diffused outside from a front part 57 composed of air permeable fibers or air permeable mesh. Therefore, when the coat 55 is worn over the jacket 49, the inside of the coat 55 is filled with warm air by circulation of warm air released from the back part 50 of the jacket 49, so that the upper half of the body A can be warmed comfortably. The back part 50 may also be composed of air permeable fibers or air permeable mesh.

Thus, the invention comprises a mount for mounting a catalytic combustion heating device including a catalytic combustion heating unit for generating heat by oxidation reaction of fuel gas and air, and a holding band for fastening the mount to the body wearing the jacket. Therefore, the load applied to the shoulders through the jacket when the jacket is worn is dispersed into other parts fixing the mount and is lessened, so that the feeling of wear is improved.

Moreover, the moving passage of warm air heated by the catalytic combustion heating unit is composed of a fuel tank for storing fuel and a coat worn over the jacket and the jacket. Therefore, by generating heat by oxidation reaction of the fuel gas and air, it is not necessary to form moving passage of warm air in the jacket, so that the constitution of the jacket may be simplified.

Still more, if the temperature of the combustion unit is lower than the set temperature, the fuel regulator is opened, and the ignition unit is put in operation. Therefore, the body can be warmed comfortably by controlling the combustion unit at lower temperature depending on the ambient temperature.

What is claimed is:

1. An apparatus comprising:

a fuel tank for storing fuel gas;

a catalytic combustion heating device including a catalytic combustion heating unit for generating heat by an oxidation reaction between the fuel gas and air;

a jacket including a mount for mounting said catalytic combustion heating device; and a holding band for fastening said mount to a body wearing said jacket.

2. The apparatus of claim 1, wherein said holding band is formed so as to fasten said mount to a waist of the body wearing said jacket.

3. The apparatus of claim 2, wherein said jacket includes a front portion having two side sections and a coupling member for coupling said two side sections, said holding band being provided between an inner surface of said front portion and the body.

4. The apparatus of claim 2, wherein said holding band is formed so as to be capable of expanding and contracting.

5. The apparatus of claim 2, wherein said holding band includes an adjuster for adjusting a length of said holding band.

6. The apparatus of claim 2, wherein said jacket includes a back portion, said mount being provided at said back portion, said back portion including a lining, a surface cloth, and a spacer between said lining and said surface cloth so as to form a warm air moving passage between said lining and said surface cloth.

7. The apparatus of claim 2, wherein said jacket includes a back portion and a front portion, said mount being provided at said back portion, further comprising an air pipe for providing air to said catalytic combustion heating unit, wherein said air pipe includes an air inlet at said front portion of said jacket.

8. The apparatus of claim 2, further comprising shoulder straps attached to said mount, said shoulder straps being formed so as to be supported by shoulders of the body.

9. The apparatus of claim 1, wherein said jacket includes a front portion having two side sections and a coupling member for coupling said two side sections, said holding band being provided between an inner surface of said front portion and the body.

10. The apparatus of claim 9, wherein said holding band is formed so as to be capable of expanding and contracting.

11. The apparatus of claim 9, wherein said holding band includes an adjuster for adjusting a length of said holding band.

12. The apparatus of claim 9, wherein said jacket further includes a back portion, said mount being provided at said back portion, said back portion including a lining, a surface cloth, and a spacer between said lining and said surface cloth so as to form a warm air moving passage between said lining and said surface cloth.

13. The apparatus of claim 9, wherein said jacket further includes a back portion, said mount being provided at said back portion, further comprising an air pipe for providing air to said catalytic combustion heating unit, wherein said air pipe includes an air inlet at said front portion of said jacket.

14. The apparatus of claim 1, wherein said holding band is formed so as to be capable of expanding and contracting.

15. The apparatus of claim 14, wherein said holding band includes an adjuster for adjusting a length of said holding band.

16. The apparatus of claim 14, wherein said jacket includes a back portion, said mount being provided at said back portion, said back portion including a lining, a surface cloth, and a spacer between said lining and said surface cloth so as to form a warm air moving passage between said lining and said surface cloth.

17. The apparatus of claim 14, wherein said jacket includes a back portion and a front portion, said mount being provided at said back portion, further comprising an air pipe for providing air to said catalytic combustion heating unit, wherein said air pipe includes an air inlet at said front portion of said jacket.

18. The apparatus of claim 1, wherein said holding band includes an adjuster for adjusting a length of said holding band.

19. The apparatus of claim 18, wherein said jacket includes a back portion, said mount being provided at said back portion, said back portion including a lining, a surface cloth, and a spacer between said lining and said surface cloth so as to form a warm air moving passage between said lining and said surface cloth.

20. The apparatus of claim 18, wherein said jacket includes a back portion and a front portion, said mount being provided at said back portion, further comprising an air pipe for providing air to said catalytic combustion heating unit, wherein said air pipe includes an air inlet at said front portion of said jacket.

21. The apparatus of claim 1, wherein said jacket includes a back portion, said mount being provided at said back portion, said back portion including a lining, a surface cloth, and a spacer between said lining and said surface cloth so as to form a warm air moving passage between said lining and said surface cloth.

22. The apparatus of claim 21, wherein said jacket further includes a front portion, further comprising an air pipe for providing air to said catalytic combustion heating unit, wherein said air pipe includes an air inlet at said front portion of said jacket.

23. The apparatus of claim 1, wherein said jacket includes a back portion and a front portion, said mount being provided at said back portion, further comprising an air pipe for providing air to said catalytic combustion heating unit, wherein said air pipe includes an air inlet at said front portion of said jacket.

24. The apparatus of claim 1, further comprising shoulder straps attached to said mount, said shoulder straps being formed so as to be supported by shoulders of the body.

25. An apparatus comprising:

a fuel tank for storing fuel gas;

a catalytic combustion heating device including a catalytic combustion heating unit for generating heat by an oxidation reaction between fuel gas and air; and a jacket for mounting said catalytic combustion heating device, wherein a warm air moving passage of warm air heated by said catalytic combustion heating device is formed between said jacket and an article of clothing worn over said jacket.

26. The apparatus of claim 25, wherein said jacket includes a back portion, said catalytic combustion heating unit being provided at said back portion, whereby air heated by said catalytic combustion heating unit is released into the warm air moving passage.

27. The apparatus of claim 26, further comprising a spacer extending from said back portion away from a body wearing said jacket.

28. The apparatus of claim 26, wherein said jacket further includes a front portion, wherein at least one of said front portion and said back portion comprises air permeable fibers.

29. The apparatus of claim 25, wherein said jacket includes a back portion, further comprising a spacer extending from said back portion away from a body wearing said jacket.

30. The apparatus of claim 29, wherein said jacket further includes a front portion, wherein at least one of said front portion and said back portion comprises air permeable fibers.

31. The apparatus of claim 25, wherein said jacket includes a front portion and a back portion, wherein at least one of said front portion and said back portion comprises air permeable fibers.

32. The apparatus of claim 31, wherein said jacket includes a front portion and a back portion, wherein said at least one of said front portion and said back portion comprises air permeable mesh.

33. An apparatus comprising:

a fuel tank for storing fuel gas;

a combustion unit for generating heat by an oxidation reaction between the fuel gas and air;

a temperature sensor for detecting a temperature of said combustion unit;

a fuel regulator for controlling a supply of the fuel gas flowing into said combustion unit from said fuel tank;

an ignition unit for igniting the fuel gas supplied through said fuel regulator;

a temperature setting unit for setting a specified temperature of said combustion unit;

a controller for controlling said fuel regulator and said ignition unit based on an output signal from said temperature sensor and an output signal from said temperature setting unit, wherein said controller opens said fuel regulator and operates said ignition unit when a temperature of said combustion unit is below said specified temperature; and a power source unit for providing power to said temperature sensor, said fuel regulator, said ignition unit, and said controller.

34. The apparatus of claim 33, wherein said controller operates to stop said ignition unit after said ignition unit has operated for a specified length of time.

35. The apparatus of claim 34, further comprising a catalyst for inducing an oxidation reaction between the fuel gas and air, wherein said combustion unit, said catalyst, and said ignition unit are integrated so as to form a catalytic combustion heating unit, and wherein said fuel tank, said fuel regulator, and said controller are integrated so as to form a fuel tank unit, said combustion unit being linked to said fuel tank.

36. The apparatus of claim 33, further comprising a catalyst for inducing an oxidation reaction between the fuel gas and air, wherein said combustion unit, said catalyst, and said ignition unit are integrated so as to form a catalytic combustion heating unit, and wherein said fuel tank, said fuel regulator, and said controller are integrated so as to form a fuel tank unit, said combustion unit being linked to said fuel tank.

37. An apparatus comprising:

a fuel tank for storing fuel gas;

a combustion unit for generating heat by an oxidation reaction between the fuel gas and air;

a temperature sensor for detecting a temperature of said combustion unit;

a fuel regulator for controlling a supply of the fuel gas flowing into said combustion unit from said fuel tank;

a catalytic combustion heating device including a controller for controlling said fuel regulator based on an output signal of temperature sensor;

a jacket including a mount for mounting said catalytic combustion heating device; and a holding band for fastening said mount to a body wearing said jacket, wherein said holding band fastens said mount to a waist of the body.

38. An apparatus comprising:

a fuel tank for storing fuel gas;

a catalytic combustion heating device including a catalytic combustion heating unit for generating heat by an oxidation reaction between the fuel gas and air; and a jacket for mounting said catalytic combustion heating device, wherein said jacket includes a back portion, said catalytic combustion heating unit being provided at said back portion, a warm air moving passage being formed between said jacket and an article of clothing worn over said jacket, whereby air heated by said catalytic combustion heating unit is released into the warm air moving passage.

39. An apparatus comprising:

a fuel tank for storing fuel gas;

a combustion unit for generating heat by an oxidation reaction between the fuel gas and air;

a temperature sensor for detecting a temperature of said combustion unit;

a fuel regulator for controlling a supply of the fuel gas flowing into said combustion unit from said fuel tank;

an ignition unit for igniting the fuel gas supplied through said fuel regulator;

a temperature setting unit for setting a specified temperature of said combustion unit;

a controller for controlling said fuel regulator and said ignition unit based on an output signal from said temperature sensor and an output signal from said temperature setting unit, wherein said controller operates said ignition unit by opening said fuel regulator when a temperature of said combustion unit is below said specified temperature, and wherein said controller operates to stop said ignition unit after said ignition unit has operated for a specified length of time; and a power source unit for providing power to said temperature sensor, said fuel regulator, said ignition unit, and said controller.

40. An apparatus comprising:

a fuel tank for storing fuel gas;

a catalytic combustion heating device including a catalytic combustion heating unit for generating heat by an oxidation reaction between the fuel gas and air;

a jacket including a mount for mounting said catalytic combustion heating device; and a holding band for fastening said mount to a body wearing said jacket, wherein said holding band fastens said mount to a waist of the body, wherein a warm air moving passage is formed between said jacket and an article of clothing worn over said jacket.

* * * * *